US009099807B2

(12) United States Patent
Opgenorth

(10) Patent No.: US 9,099,807 B2
(45) Date of Patent: Aug. 4, 2015

(54) RELEASABLE LOCKING CONNECTOR ASSEMBLY

(71) Applicant: ITT Manufacturing Enterprises, LLC, Wilmington, DE (US)

(72) Inventor: Jesse Allen Opgenorth, Costa Mesa, CA (US)

(73) Assignee: ITT Manufacturing Enterprises, LLC, Wilmington, DE (US)

( * ) Notice: Subject to any disclaimer, the term of this patent is extended or adjusted under 35 U.S.C. 154(b) by 54 days.

(21) Appl. No.: 14/097,679

(22) Filed: Dec. 5, 2013

(65) Prior Publication Data

US 2015/0162702 A1 Jun. 11, 2015

(51) Int. Cl.

| | |
|---|---|
| ***H01R 13/62*** | (2006.01) |
| ***H01R 13/622*** | (2006.01) |
| ***H01R 13/623*** | (2006.01) |
| ***H01R 13/621*** | (2006.01) |
| ***H01R 13/625*** | (2006.01) |

(52) U.S. Cl.

CPC ..... *H01R 13/622* (2013.01); *H01R 13/62* (2013.01); *H01R 13/621* (2013.01); *H01R 13/623* (2013.01); *H01R 13/625* (2013.01)

(58) Field of Classification Search

USPC ..... 439/321, 306, 310, 315, 318, 320

See application file for complete search history.

(56) References Cited

U.S. PATENT DOCUMENTS

| | | | | |
|---|---|---|---|---|
| 2,728,895 | A | 10/1954 | Quackenbush et al. | |
| 3,470,524 | A | 9/1969 | Culver | |
| 3,917,373 | A | 11/1975 | Peterson | |
| 5,035,640 | A | 7/1991 | Drogo | |
| 5,192,219 | A | 3/1993 | Fowler et al. | |
| 5,366,383 | A | 11/1994 | Dearman | |
| 5,653,605 | A * | 8/1997 | Woehl et al. | 439/321 |
| 5,727,850 | A | 3/1998 | Masclet | |
| 5,851,035 | A | 12/1998 | Marc et al. | |
| 5,971,787 | A | 10/1999 | Brown | |
| 6,086,400 | A * | 7/2000 | Fowler | 439/321 |
| 6,123,563 | A * | 9/2000 | Johnson et al. | 439/321 |
| 6,152,753 | A * | 11/2000 | Johnson et al. | 439/321 |
| 6,162,095 | A * | 12/2000 | Holman | 439/607.59 |
| 6,375,509 | B2 * | 4/2002 | Mountford | 439/607.41 |
| 6,666,614 | B2 | 12/2003 | Fechter et al. | |

(Continued)

FOREIGN PATENT DOCUMENTS

| | | | |
|---|---|---|---|
| DE | 102004013570 | A | 10/2005 |
| EP | 0645572 | B | 3/1995 |

(Continued)

*Primary Examiner* — Abdullah Riyami
*Assistant Examiner* — Harshad Patel
(74) *Attorney, Agent, or Firm* — RatnerPrestia

(57) ABSTRACT

A releasable locking connector assembly includes a coupling nut rotatably coupled to a connector body; splines on the connector body or the coupling nut; and a lock ring having mating splines that is translatable with respect to the connector body and the coupling nut between engaged and disengaged positions. The mating splines engage the splines when the lock ring is in the engaged position to prevent rotation of the coupling nut, and the mating splines are spaced from the splines when the lock ring is in the disengaged position to permit rotation of the coupling nut. A moveable index ring is movable between a locked position, in which the lock ring is in the engaged position, and an unlocked position, in which the lock ring is in the disengaged position. A push ring sequentially moves the moveable index ring between the locked and unlocked positions.

20 Claims, 5 Drawing Sheets

(56) References Cited

U.S. PATENT DOCUMENTS

| | | | |
|---|---|---|---|
| 6,716,048 | B2 | 4/2004 | Collin et al. |
| 7,278,895 | B2 | 10/2007 | Levander |
| 7,682,177 | B2 | 3/2010 | Berthet |
| 7,806,621 | B2 | 10/2010 | Leroyer |
| 7,905,741 | B1 | 3/2011 | Wade et al. |
| 7,914,311 | B1 | 3/2011 | Gallusser et al. |
| 2011/0318098 | A1 | 12/2011 | Gloaguen et al. |

FOREIGN PATENT DOCUMENTS

| | | | |
|---|---|---|---|
| GB | 2019483 | A | 10/1979 |
| GB | 2331342 | A | 5/1999 |
| JP | 2003056765 | A | 2/2003 |

* cited by examiner

RELEASABLE LOCKING CONNECTOR ASSEMBLY

FIELD OF THE INVENTION

The present invention relates to locking mechanisms for coupling connectors.

BACKGROUND OF THE INVENTION

Connectors that are designed to resist uncoupling without external influences are currently using various technologies to add resistance to uncoupling forces. However, such connectors are susceptible to uncoupling caused by external forces such as vibration when such couplings are connected. There is a need for improved coupling assemblies and locking mechanisms for withstanding external forces when coupled.

SUMMARY OF THE INVENTION

According to one aspect of the invention, a releasable locking connector assembly comprises a connector body; a coupling nut that is rotatably coupled to the connector body; a first set of splines that are positioned on either the connector body or the coupling nut; a lock ring having a second set splines, the lock ring being axially movable with respect to the connector body and the coupling nut between an engaged position and a disengaged position, wherein the second set of splines of the lock ring engage the first set of splines when the lock ring is in the engaged position to prevent rotation of the coupling nut with respect to the connector body, and the second set of splines of the lock ring are disengaged from the first set of splines when the lock ring is in the disengaged position to permit rotation of the coupling nut with respect to the connector body; a moveable index ring movable between a locked position, in which the lock ring is maintained in the engaged position, and an unlocked position, in which the lock ring is maintained in the disengaged position; and a push ring for sequentially moving the moveable index ring between the locked and unlocked positions.

According to another aspect of the invention, a releasable locking connector assembly comprises a connector body; a coupling nut that is rotatably coupled to the connector body; a lock ring that is axially movable with respect to the connector body and the coupling nut between an engaged position, in which rotation of the coupling nut with respect to the connector body is prevented, and a disengaged position, in which rotation of the coupling nut with respect to the connector body is permitted; a moveable index ring that bears on the lock ring and is movable between a locked position, in which the lock ring is maintained in the engaged position, and an unlocked position, in which the lock ring is maintained in the disengaged position; and a push ring for sequentially moving the moveable index ring between the locked and unlocked positions.

According to yet another aspect of the invention, a releasable locking connector assembly comprises a connector body; a coupling nut that is rotatably coupled to the connector body; a lock ring that is axially movable with respect to the connector body and the coupling nut between an engaged position, in which rotation of the coupling nut with respect to the connector body is prevented, and a disengaged position, in which rotation of the coupling nut with respect to the connector body is permitted; a rotatable index ring that bears on the lock ring and is movable between a locked position, in which the lock ring is maintained in the engaged position, and an unlocked position, in which the lock ring is maintained in the disengaged position; and a fixed index ring that cooperates with the rotatable index ring, wherein the rotatable index ring is positionable on the fixed index ring to either the locked position or the unlocked position.

BRIEF DESCRIPTION OF THE DRAWINGS

The invention is best understood from the following detailed description when read in connection with the accompanying drawings, with like elements having the same reference numerals. Included in the drawings are the following figures.

DETAILED DESCRIPTION OF THE INVENTION

Figure 1A:
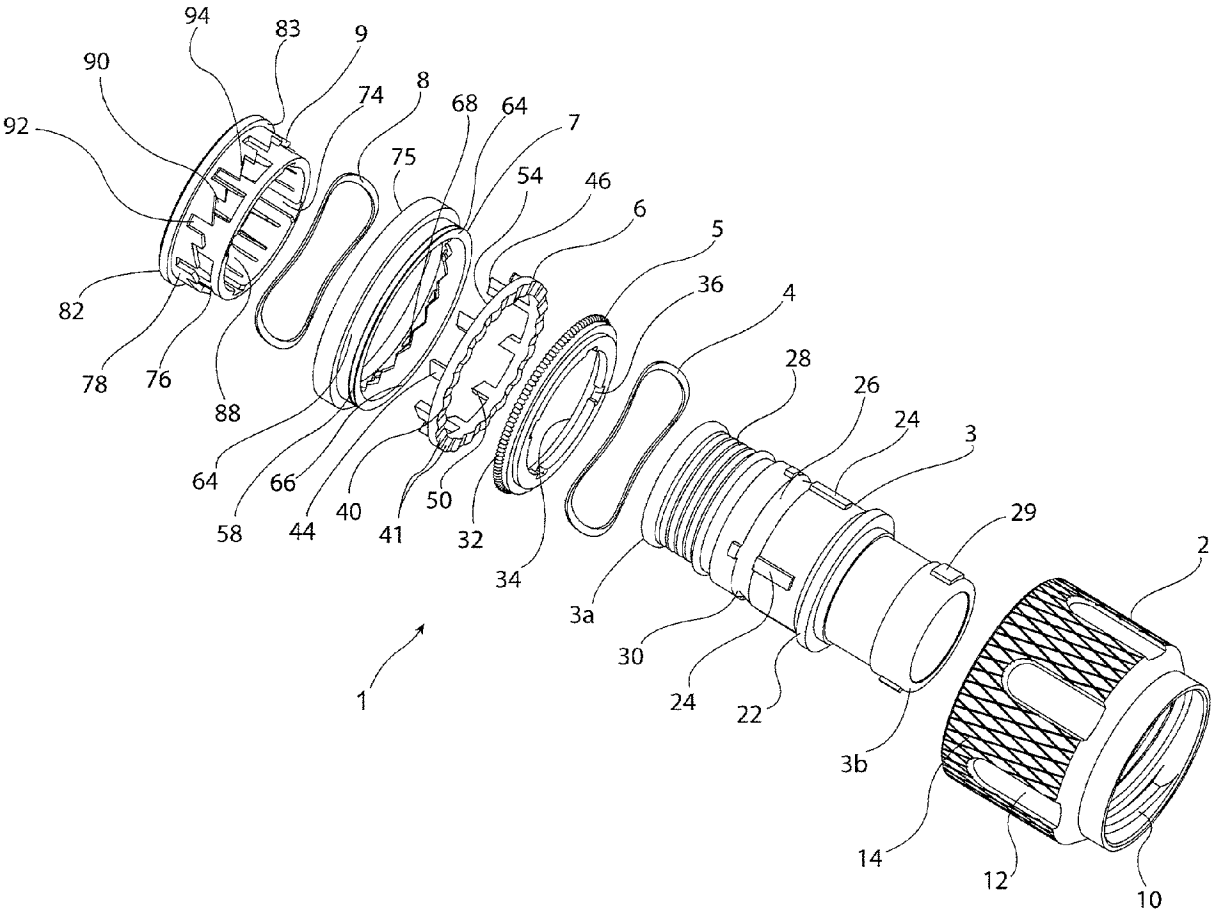
FIG. 1A is an exploded view of a locking connector assembly according to one exemplary embodiment of the invention.
Figure 1B:
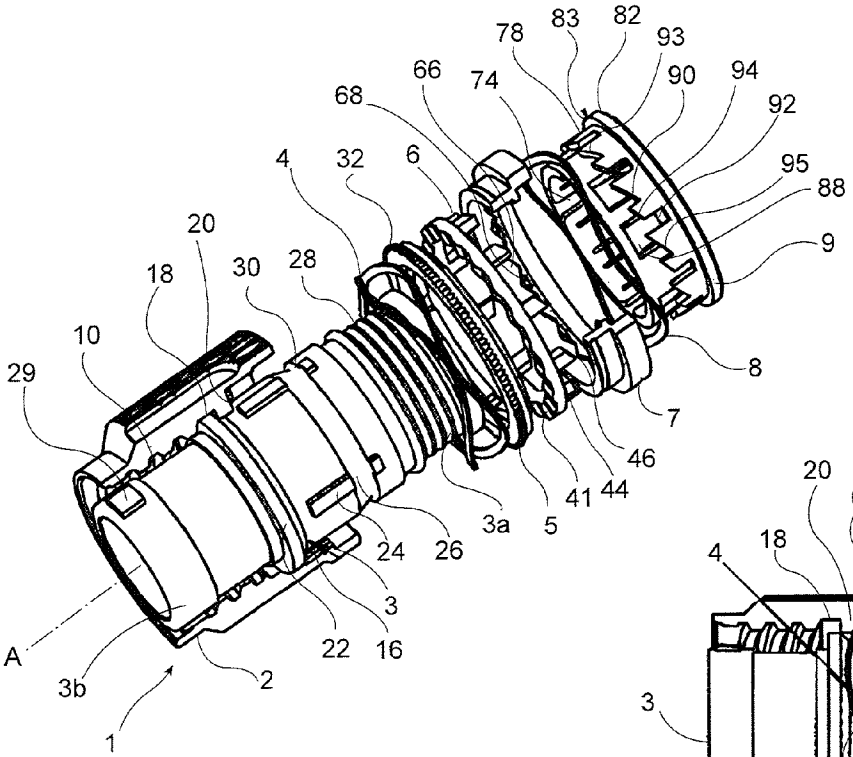
FIG. 1B is a partially exploded view of the locking connector assembly.
Figure 1C:
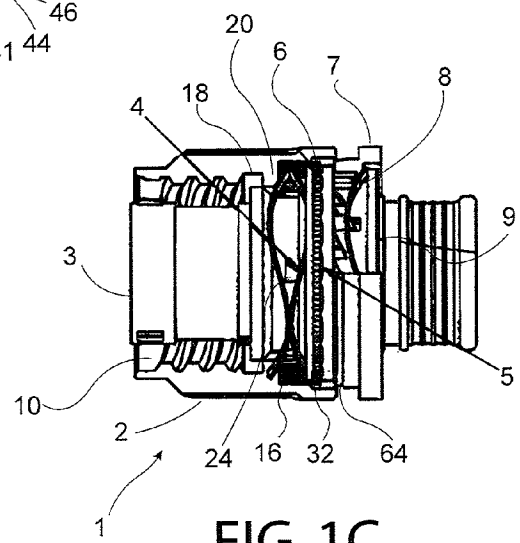
FIG. 1C is a cross-sectional side view of the locking connector assembly shown in an assembled configuration.

FIGS. 1A-1C depict a releasable locking connector assembly 1 according to one exemplary embodiment of the invention. Unless otherwise noted, each of the components of the locking connector assembly 1 has a substantially cylindrical shape with a hollow interior. Also, as used herein, the term 'distal' refers to a position either at or toward a first end 3*a* of a connector body 3, and the term 'proximal' refers to a position either at or toward the second end 3*b* of the connector body 3.

The releasable locking connector assembly 1 generally comprises a coupling nut 2 that is releasably fixed to a hollow connector body 3 by a lock ring 5; a fixed index ring 9 that is fixedly coupled to the connector body 3; a push ring 7 that is slidably and non-rotatably coupled to the fixed index ring 9; a rotatable index ring 6 (also referred to herein as a moveable index ring) that engages the fixed index ring 9 and is sandwiched between the push ring 7 and the lock ring 5; a first resilient member 4 that is positioned to bias the lock ring 5 away from the coupling nut 2; and a second resilient member 8 that is positioned to bias the push ring 7 against the rotatable index ring 6, and bias the rotatable index ring 6 against the lock ring 5.

The locking connector assembly 1 is movable between a locked position and an unlocked position. In the locked position of the assembly 1, the coupling nut 2 is incapable of rotating on the connector body 3 thereby preventing removal of the nut 2 from a coupling member (not shown) that is threadedly attached to the nut 2. In the unlocked position of the locking connector assembly 1, the coupling nut 2 is capable of rotating on the connector body 3, thereby permitting removal of the nut 2 (along with the entire locking connector assembly 1) from the coupling member (not shown) that is threadedly attached to the nut 2.

Referring now to the individual components of the assembly 1, the connector body 3 includes an elongated cylindrical body upon which the remaining components of the assembly 1 are mounted either directly or indirectly. The distal end 3*a* of the connector body 3 includes an area 28 that accepts optional connector accessories (not shown). The proximal end 3*b* of the connector body 3 includes lugs 29 that can engage a coupling member (not shown) that is coupled to the coupling nut 2.

A series of axially extending rails 24 are provided on the exterior surface of the connector body 3. The rails 24 are positioned through respective axial channels 36 in the lock ring 5 and channels 74 in the fixed index ring 9. Engagement between the rails 24 and the channels 36 and 74 prevents the lock ring 5 and the fixed index ring 9 from rotating with respect to the connector body 3. It should be understood that the rails may be positioned on the rings 5 and 9 and the channels may be provided on the connector body 3 to achieve the same result.

An annular recessed surface 26 is defined on the exterior surface of the connector body 3. The recessed surface 26 is configured to accommodate resilient tabs 88 that are disposed on the surface 76 of the fixed index ring 9. The top surface 89 (see FIG. 2A) of each tab 88 bears on the shoulder 30 of the recessed surface 26. Engagement between the tabs 88 and the recessed surface 26 prevents translation of the index ring 9 along the connector body 3. Unlike the index ring 9, the lock ring 5 is capable of translating along the connector body 3.

An outwardly extending shoulder portion 22 is formed on the outer surface of the connector body 3 for engaging the coupling nut 2. In an assembled form of the assembly 1, the shoulder portion 22 is disposed in a recess 18 that is defined in the coupling nut 2.

The coupling nut 2 is adapted to rotate clockwise and counterclockwise with respect to the connector body 3 in the unlocked position of the assembly 1. Internal threads 10 are defined on the proximal end of the coupling nut 2. The threads 10 are configured to be threadedly connected to the coupling member (not shown). The threads 10 may be substituted with bayonets or other fastening means. A series of splines 16 are defined on the distal end of the coupling nut 2. The splines 16 are adapted to releasably engage corresponding splines 32 on the circumference of the lock ring 5. A grip pattern 14 is provided on the outer surface of the coupling nut 2 to facilitate rotation of the coupling nut 2. Axially-extending channels 12 are defined on the exterior surface of the coupling nut. The channels 12 are adapted to provide extra grip or match projections (not shown) on a tool (e.g., a ratchet, a wrench, etc.) that is used to rotate the coupling nut 2. The size and shape of the channels 12 may vary from that which is shown and described. Also, the channels 12 are optional features of the coupling nut 2.

The first resilient member 4 is positioned between the lock ring 5 and the coupling nut 2 to bias the lock ring 5 in a distal direction away from the coupling nut 2. The resilient member 4 may be a spring, a wave spring, etc. The resilient member 4 may include one resilient element as depicted in FIG. 1A or multiple resilient elements as depicted in FIGS. 1B and 1C. Other suitable resilient members will be understood by one of skill in the art from the description herein.

The lock ring 5 is translatably positioned within the annular space that is defined between the coupling nut 2 and the connector body 3. A series of axially-extending splines 32 are provided along at least a portion of the circumference of the lock ring 5.

The rotatable index ring 6 is sandwiched between the lock ring 5 and the push ring 7. The proximal end surface 40 of the rotatable index ring 6 has an undulating profile 41. The undulating profile 41 reduces the contact area between the index ring 6 and the distal end face 34 of the lock ring 5, thereby providing for easier rotation of the rotatable index ring 6. The distal end face 54 of the rotatable index ring 6 includes a series of protruding elements 44, each of which project in a distal direction toward the fixed index ring 9. The protruding elements 44 are also referred to hereinafter as teeth 44.

The push ring 7 is sandwiched between the rotatable index ring 6 and the resilient member 8. The push ring 7 is slidably and non-rotatably positioned over the fixed index ring 9 such that at least a portion of the fixed index ring 9 is positioned within the interior of the push ring 7. The rotatable index ring 6 is at least partially positioned within the interior of the push ring 7.

The interior circumference of the push ring 7 includes a protruding surface 66 having a saw-tooth profile. The protruding surface 66 is also referred to hereinafter collectively as teeth 66. The apex of each tooth 66 is positioned to bear on the center of a respective tooth 44 of the rotatable index ring 6 to cause translation and rotation of the rotatable index ring 6, thereby moving the assembly 1 between locked and unlocked positions.

A series of alignment elements 68 protrude inwardly from alternating teeth 66 toward the axis of rotation 'A.' Each alignment element 68 has a triangular shaped cross-section, which matches the shape of the tooth 66 from which it extends. The alignment elements 68 are sized to fit within a respective unlock channel 92 of the fixed index ring 9. Engagement between the alignment elements 68 and the unlock channels 92 prevents rotation of the push ring 7 with respect to the other components of the assembly 1, and permits translation of the push ring 7 along the depth dimension of the unlock channels 92. The alignment elements 68 may also be referred to herein as teeth 68.

The push ring 7 includes an outer surface 64 that is visible when the locking connector assembly 1 is in the unlocked position, thereby providing an indication to the user as to whether the locking connector assembly 1 is maintained in either the locked or the unlocked position. By comparing FIGS. 2A and 3A, it is seen that the coupling nut 2 is disposed over a portion outer surface 64 when the locking connector assembly 1 is in the locked position. It is contemplated that the outer surface 64 may be of a color different than the other components of the assembly 1 to sufficiently indicate whether the locking connector assembly 1 is in the locked or unlocked position. The surface 64 may also include indicia such arrows and/or text to identify the locked and unlocked positions.

The fixed index ring 9 is rotationally and translationally fixed to the exterior surface of the connector body 3, as previously described. The fixed index ring 9 includes a top portion 82, a structured portion 78 that extends from the shoulder 83 of the top portion 82, and a wall 76 that includes the plurality of resilient tabs 88. The wall 76 of the fixed index ring 9 extends at least partially through the second resilient member 8, the push ring 7, the rotatable index ring 6 and the lock ring 5.

The structured portion 78 of the fixed index ring 9 includes alternating unlock channels 92 and lock channels 90 that form an intricate saw tooth profile. The teeth 44 of the rotatable index ring 6 are received in the unlock channels 92 and lock channels 90 in an alternating manner. In other words, in an unlocked position of the assembly 1, all of the teeth 44 are positioned in the unlock channels 92. Conversely, in a locked position of the assembly 1, all of the teeth 44 are positioned in the lock channels 90. The depth '$D_L$' of each lock channel 90 is less than the depth '$D_U$' of each unlock channel 92. The depth of each channel 90 and 92 influences the position of the splines 32 of the lock ring 5 with respect to the splines 16 of the nut 2.

The second resilient member 8 is sandwiched between the underside surface of the shoulder 83 of the fixed index ring 9 and the distal end face 75 of the push ring 7. The second resilient member 8 biases the push ring 7 in a proximal direction toward the coupling nut 2, thereby creating an opposing biasing force with the first resilient member 4. The second resilient member 8 may be a spring, a wave spring, etc. The second resilient member 8 may include one or more resilient elements, as depicted. Other elements for biasing the locking connector assembly will be understood by one of skill in the art from the description herein.

Figure 2B:
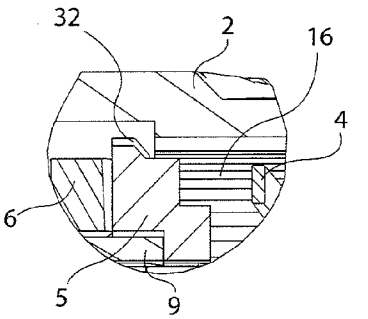
FIGS. 2A and 2B are side and detailed views, respectively, of the locking connector assembly shown in an unlocked position and partially cut away.
Figure 2A:
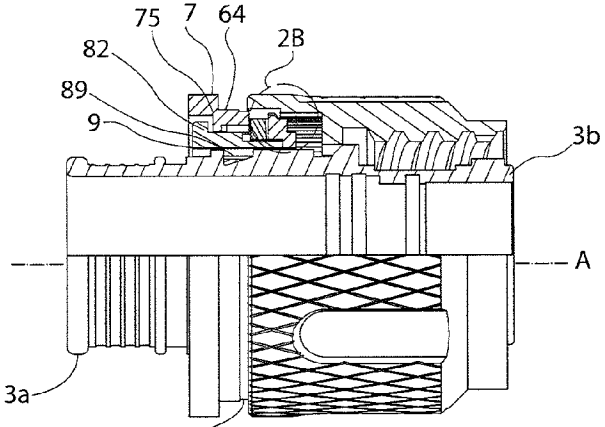

FIGS. 2A and 2B depict the locking connector assembly 1 in an unlocked position. In the unlocked position of the assembly 1, the lock ring 5 is in the disengaged position because the splines 32 of the lock ring 5 are separated and disengaged from the corresponding splines 16 of the coupling nut 2 thereby permitting rotation of the coupling nut 2 with respect to the connector body 3. In the unlocked position of the assembly 1, the proximal section 58 of the push ring 7, and any indicia applied thereto, is visible to a user of the assembly 1.

FIGS. 4A, 4B, 5A and 5B also depict the locking connector assembly 1 in an unlocked position. In the unlocked position of the assembly 1, each tooth 44 of the rotatable index ring 6 is positioned within a respective unlock channel 92 of the fixed index ring 9. Each alignment element 68 is also disposed within a respective unlock channel 92. The depth '$D_U$' of the unlock channels 92 is sized so that when the teeth 44 are positioned therein, the lock ring 5, which is biased against the rotatable index ring 6 by the resilient member 4, is positioned such that the splines 32 are separated from and disengaged with the splines 16 of the coupling nut 2. Because the lock ring 5 is disconnected from the coupling nut 2, the coupling nut 2 is able to rotate with respect to the connector body 3.

Figure 3B:
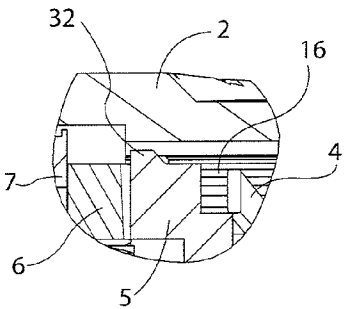
FIGS. 3A and 3B are side and detailed views, respectively, of the locking connector assembly shown in a locked position and partially cut away.
Figure 3A:
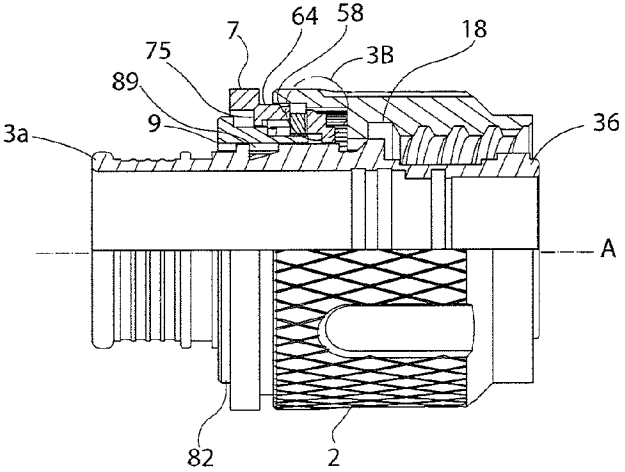
Figure 4A:
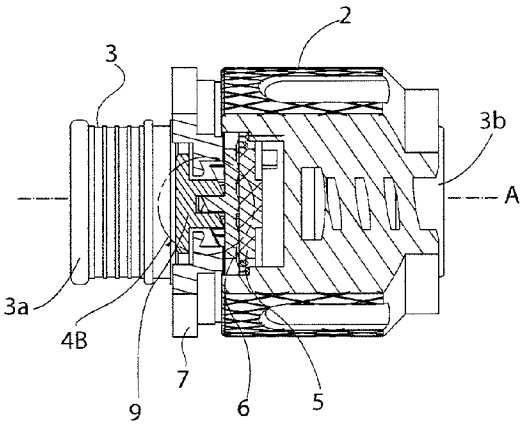
FIGS. 4A and 4B are side and detailed views, respectively, of the locking connector assembly shown in an unlocked position and partially cut away.
Figure 4B:
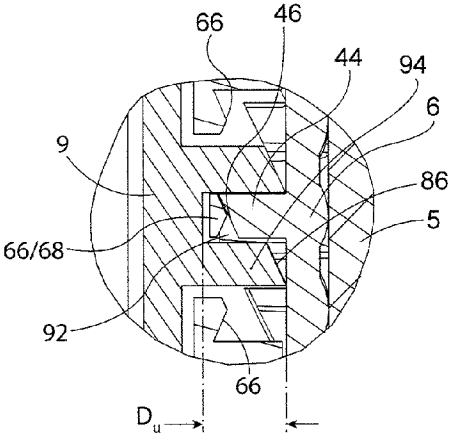
Figure 5A:
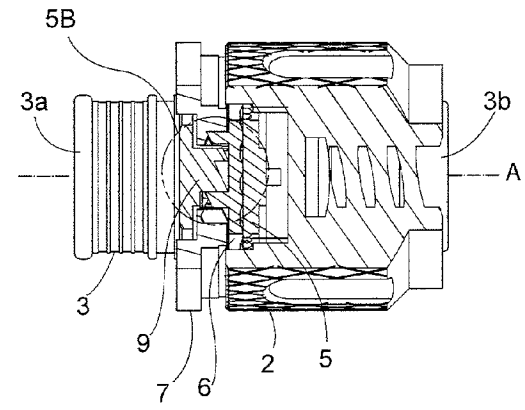
FIGS. 5A and 5B are side and detailed views, respectively, of the locking connector assembly shown in an unlocked position and partially cut away.
Figure 5B:
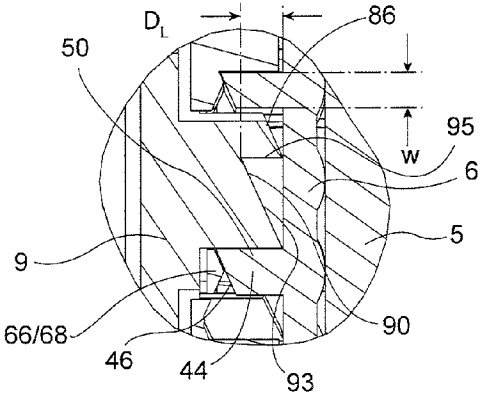

FIGS. 3A and 3B depict the locking connector assembly 1 in a locked position. In the locked position of the assembly 1, the splines 32 of the lock ring 5 are engaged with the corresponding splines 16 of the coupling nut 2 thereby preventing rotation of the coupling nut 2 with respect to the connector body 3. More specifically, the lock ring 5 is fixed to the coupling nut 2 by the splines 16 and 32, and the lock ring 5 is also fixed to the connector body 3 by engagement between the rails 24 and slots 36. Because the lock ring 5 is rotationally locked to both the coupling nut 2 and the connector body 3, the coupling nut 2 is locked and prevented from rotating on the connector body 3.

Additionally, in the locked position of the assembly 1, the coupling nut 2 is disposed over the lower section 58 of the push ring 7 such that the lower section 58, and any indicia applied thereto, is not visible to a user.

Figure 6B:
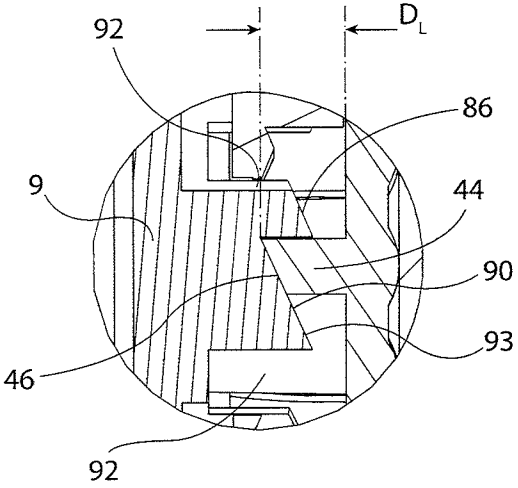
FIGS. 6A and 6B are side and detailed views, respectively, of the locking connector assembly shown in a locked position and partially cut away.
Figure 6A:
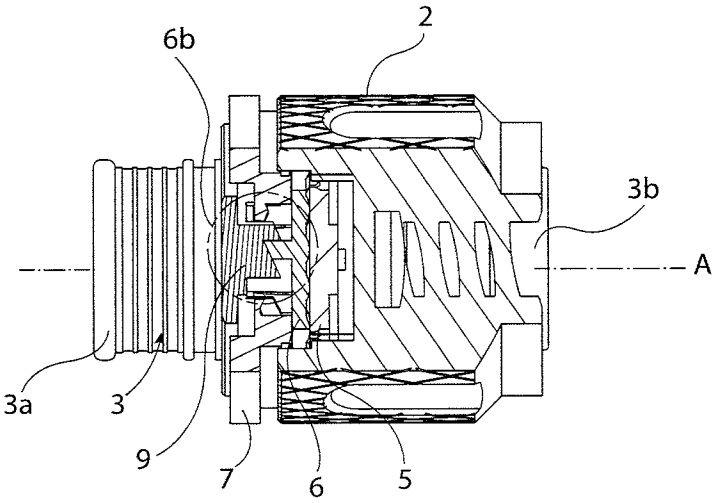

FIGS. 6A and 6B also depict the locking connector assembly 1 in a locked position. In the locked position of the assembly 1, the teeth 44 of the rotatable index ring 6 are positioned in the lock channels 90 of the fixed index ring 9 thereby causing the splines 32 of the lock ring 5 to engage with the corresponding splines 16 of the coupling nut 2. In the locked position, the slanted surfaces 46 of the teeth 44 contact the slanted surfaces 93 of respective lock channels 90. The depth '$D_L$' of the lock channels 90 is sized so that when the teeth 44 are positioned therein, the splines 32 of the lock ring 5 are meshed and engaged with the corresponding splines 16 of the coupling nut 2.

Operation of the locking connector assembly 1 will now be described with reference to FIGS. 2A-6B in accordance with one exemplary embodiment of the invention. When the locking connector assembly 1 is maintained in the unlocked position, as shown in FIGS. 2A, 2B and 4A-5B, the teeth 44 are positioned in the unlock channels 92 of the fixed index ring 9 and the splines 32 of the lock ring 5 are separated from the corresponding splines 16 of the coupling nut 2, as described above.

To move the assembly 1 from the unlocked position to the locked position, the user depresses the push ring 7 in a proximal direction toward the coupling nut 2. This causes the teeth 66 and 68 of the push ring 7 to bear on the teeth 44 of the rotatable index ring 6, which causes the rotatable index ring 6 to bear on the lock ring 5. Further translation of the push ring 7 translates both the rotatable index ring 6 and the lock ring 5 in the proximal direction against the force of the first resilient member 4 until the teeth 44 of the rotatable index ring 6 move outside of the unlock channels 92 of the fixed index ring 9. At this point, the lock ring 5 is sufficiently advanced in the proximal direction such that the splines 32 of the lock ring 5 are meshed and engaged with the corresponding splines 16 of the coupling nut 2. Once the teeth 44 of the rotatable index ring 6 are positioned outside of the unlock channels 92 of the fixed index ring 9, further translational movement of the push ring 7 in the proximal direction against the force of the compressed first resilient member 4 causes the slanted surfaces 46 of the teeth 44 of the rotatable index ring 6 to slide along the slanted surfaces of the teeth 66 and 68 of the push ring 7. The sliding action of the teeth 44 of the rotatable index ring 6 results in the rotation of the rotatable index ring 6 about the longitudinal axis 'A.' The rotatable index ring 6 rotates by a distance equal to half of the width 'W' (see FIG. 5B) of the teeth 44 until the teeth 44 of the rotatable index ring 6 are aligned with, but are still positioned outside of, the lock channels 90 of the fixed index ring 9 that are directly adjacent to the unlock channels 92 in which the teeth 44 were previously positioned.

The push ring 7 is then released by the user. Releasing the push ring 7 causes the resilient member 4 to translate the lock ring 5, the rotatable index ring 6 and the push ring 7 in the distal direction (i.e., away from the coupling nut 2). The teeth 44 of the rotatable index ring 6 move into the entrance of the lock channels 90. The resilient member 4 then presses the slanted surfaces 46 of the teeth 44 against the respective slanted surfaces 93 of the lock channels 90. Due to the matching geometries of the aforementioned surfaces, the biasing force provided by the resilient member 4 causes the rotatable index ring 6 to rotate further in the same rotational direction, moving the teeth 44 radially further into the lock channels 90. The rotatable index ring 6 continues to rotate until the tall sides 50 of the teeth 44 come into contact with the walls 95 of the respective lock channels 90. When the teeth 44 are seated within their respective lock channels 90, the splines 16 and 32 are engaged and the assembly 1 is maintained in the locked position, as was described previously. In the locked position, the lower section 58 of the push ring 7 is not visible, indicating the locking connector assembly 1 is in the locked position.

To move the assembly 1 from the locked position to the unlocked position, the user depresses the push ring 7 in a proximal direction toward the coupling nut 2. This causes the teeth 66 of the push ring 7 to bear on the teeth 44 of the rotatable index ring 6, which causes the rotatable index ring 6 to bear on the lock ring 5. Further translation of the push ring 7 translates both the rotatable index ring 6 and the lock ring 5 in the proximal direction against the force of the first resilient member 4 until the teeth 44 of the rotatable index ring 6 move outside of the lock channels 90 of the fixed index ring 9. At this point, the lock ring 5 is sufficiently advanced in the proximal direction such that the splines 32 of the lock ring 5 are meshed and engaged with the corresponding splines 16 of the coupling nut 2. Once the teeth 44 of the rotatable index ring 6 are positioned outside of the lock channels 90 of the fixed index ring 9, further translational movement of the push ring 7 in the proximal direction against the force of the compressed first resilient member 4 causes the slanted surfaces 46 of the teeth 44 of the rotatable index ring 6 to rotate by a distance equal to half of the width 'W' (see FIG. 5B) of the teeth 44 along the slanted surfaces of the teeth 66 of the push ring 6. In other words, the sliding action of the teeth 44 of the rotatable index ring 6 results in the rotation of the rotatable index ring 6 about the longitudinal axis 'A.' The rotatable index ring 6 rotates until the teeth 44 of the rotatable index ring 6 are aligned with, but are still positioned outside of, the respective surfaces 86 of the walls 94 of the fixed index ring 9 that are directly adjacent to the lock channels 90 in which the teeth 44 were previously positioned. It should be understood that the rotatable index ring 6 only rotates in a single rotational direction, according to this exemplary embodiment of the invention.

The push ring 7 is then released by the user. Releasing the push ring 7 causes the resilient member 4 to translate the lock ring 5, the rotatable index ring 6 and the push ring 7 in the distal direction (i.e., away from the coupling nut 2). The teeth 44 of the rotatable index ring 6 move against the slanted surfaces 86. The resilient member 4 continues to press the slanted surfaces 46 of the teeth 44 against the respective slanted surfaces 86 of the walls 94, which causes the surfaces 46 to slide along the surfaces 86 until the teeth 44 of the rotatable index ring 6 spring into the unlock channels 92.

When the teeth 44 are seated within their respective unlock channels 92, the splines 16 and 32 are separated and the assembly 1 is maintained in the unlocked position, as was described previously. In the unlocked position, the lower section 58 of the push ring 7 is visible, indicating the locking connector assembly 1 is in the unlocked position.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A releasable locking connector assembly, comprising:

a connector body;

a coupling nut that is rotatably coupled to the connector body;

a first set of splines that are positioned on either the connector body or the coupling nut;

a lock ring having a second set splines, the lock ring being axially movable with respect to the connector body and the coupling nut between an engaged position and a disengaged position, wherein the second set of splines of the lock ring are engaged with the first set of splines when the lock ring is in the engaged position in order to prevent rotation of the coupling nut with respect to the connector body, and the second set of splines of the lock ring are disengaged from the first set of splines when the lock ring is in the disengaged position in order to permit rotation of the coupling nut with respect to the connector body;

a moveable index ring that bears on the lock ring and is movable between a locked position, in which the lock ring is maintained in the engaged position, and an unlocked position, in which the lock ring is maintained in the disengaged position; and a push ring for sequentially moving the moveable index ring between the locked and unlocked positions.

2. The releasable locking connector assembly of claim 1, further comprising a resilient member that is positioned to bias the lock ring away from the coupling nut.

3. The releasable locking connector assembly of claim 1 further comprising a fixed index ring that is fixedly mounted to the connector body, wherein the fixed index ring cooperates with the moveable index ring, wherein the moveable index ring is positionable on the fixed index ring in either the locked position or the unlocked position.

4. The releasable locking connector assembly of claim 3, wherein the moveable index ring is located a different distance away from the fixed index ring in the locked position than in the unlocked position.

5. The releasable locking connector assembly of claim 3, wherein the fixed index ring includes at least one lock channel and at least one unlock channel that has a different depth dimension than the lock channel, each channel being sized to receive a protruding element of the moveable index ring.

6. The releasable locking connector assembly of claim 5, wherein the push ring includes a protruding surface for engaging the protruding element of the moveable index ring to move the moveable index ring between the at least one lock channel and at least one unlock channel of the fixed index ring.

7. The releasable locking connector assembly of claim 5, wherein the protruding element of the moveable index ring has a slanted surface that bears on the protruding surface of the push ring, and the slanted surface is configured to slide along the protruding surface of the push ring to induce rotation of the moveable index ring in a pre-determined rotational direction.

8. The releasable locking connector assembly of claim 5, wherein the protruding element of the moveable index ring has a slanted surface that is configured to slide along a slanted surface of the lock channel of the fixed index ring to induce rotation of the moveable index ring in a pre-determined rotational direction.

9. The releasable locking connector assembly of claim 5, wherein the protruding element of the moveable index ring has a slanted surface that is configured to slide along a slanted surface of the unlock channel of the fixed index ring to induce rotation of the moveable index ring in a pre-determined rotational direction.

10. The releasable locking connector assembly of claim 5, wherein the push ring includes an alignment element that is positioned in either the locked channel or the unlocked channel of the fixed index ring for preventing rotation of the push ring with respect to the fixed index ring while permitting translation of the push ring with respect to the fixed index ring.

11. The releasable locking connector assembly of claim 1, wherein the lock ring is rotationally fixed to the connector body.

12. The releasable locking connector assembly of claim 11, further comprising a rail disposed on one of the connector body and the lock ring, that is adapted to be inserted through at least one channel that is disposed on the other of the connector body and the lock ring to prevent rotation of the lock ring with respect to the connector body and permit translation of the lock ring with respect to the connector body.

13. The releasable locking connector assembly of claim 1, wherein the push ring further comprises a section that is visible to a user of the releasable locking connector assembly when the lock ring is maintained in one of the disengaged position and the engaged position, and is not visible when the lock ring is maintained in the other of the disengaged position and the engaged position.

14. The releasable locking connector assembly of claim 1 further comprising a resilient member that is positioned to bias the push ring against the moveable index ring which, in turn, biases the moveable index ring against the lock ring which, in turn, biases the lock ring toward the coupling nut.

15. A releasable locking connector assembly, comprising:

a connector body;

a coupling nut that is rotatably coupled to the connector body;

a lock ring that is axially movable with respect to the connector body and the coupling nut between an engaged position, in which rotation of the coupling nut with respect to the connector body is prevented, and a disengaged position, in which rotation of the coupling nut with respect to the connector body is permitted;

a moveable index ring that bears on the lock ring and is movable between a locked position, in which the lock ring is maintained in the engaged position, and an unlocked position, in which the lock ring is maintained in the disengaged position; and a push ring for sequentially moving the moveable index ring between the locked and unlocked positions.

16. The releasable locking connector assembly of claim 15 further comprising a fixed index ring that cooperates with the moveable index ring, wherein the moveable index ring is positionable on the fixed index ring to either the locked position or the unlocked position.

17. The releasable locking connector assembly of claim 15 further comprising a first set of splines that are positioned on either the connector body or the coupling nut, and a second set of splines that are positioned on the lock ring, wherein the second set of splines of the lock ring engage the first set of splines when the lock ring is maintained in the engaged position to prevent rotation of the coupling nut with respect to the connector body, and the second set of splines of the lock ring are disengaged from the first set of splines when the lock ring is maintained in the disengaged position to permit rotation of the coupling nut with respect to the connector body.

18. A releasable locking connector assembly, comprising:

a connector body;

a coupling nut that is rotatably coupled to the connector body;

a lock ring that is axially movable with respect to the connector body and the coupling nut between an engaged position, in which rotation of the coupling nut with respect to the connector body is prevented, and a disengaged position, in which rotation of the coupling nut with respect to the connector body is permitted;

a rotatable index ring that bears on the lock ring and is movable between a locked position, in which the lock ring is maintained in the engaged position, and an unlocked position, in which the lock ring is maintained in the disengaged position; and a fixed index ring that cooperates with the rotatable index ring, wherein the rotatable index ring is positionable on the fixed index ring to either the locked position or the unlocked position.

19. The releasable locking connector assembly of claim 18 further comprising a push ring for sequentially rotating the rotatable index ring between the locked and unlocked positions.

20. The releasable locking connector assembly of claim 18 further comprising a first set of splines that are positioned on either the connector body or the coupling nut, and a second set of splines that are positioned on the lock ring, wherein the second set of splines of the lock ring engage the first set of splines when the lock ring is maintained in the engaged position to prevent rotation of the coupling nut with respect to the connector body, and the second set of splines of the lock ring are disengaged from the first set of splines when the lock ring is maintained in the disengaged position to permit rotation of the coupling nut with respect to the connector body.

* * * * *